US010292230B2

(12) United States Patent
Shields et al.

(10) Patent No.: US 10,292,230 B2
(45) Date of Patent: May 14, 2019

(54) SYSTEM AND METHOD FOR CONTROLLING A WAYSIDE DEVICE

(71) Applicant: Alstom Transport Technologies, Saint-Ouen (FR)

(72) Inventors: William David Shields, Blue Springs, MO (US); Forrest Henry Ballinger, Grain Valley, MO (US); Jeffrey Michael Fries, Lee's Summit, MO (US); Larry John Anderson, Blue Springs, MO (US); Wayne Nelson Wheeler, Grain Valley, MO (US)

(73) Assignee: ALSTOM TRANSPORT TECHNOLOGIES, Saint-Ouen (FR)

( * ) Notice: Subject to any disclaimer, the term of this patent is extended or adjusted under 35 U.S.C. 154(b) by 32 days.

(21) Appl. No.: 15/192,653

(22) Filed: Jun. 24, 2016

(65) Prior Publication Data

US 2016/0381758 A1 Dec. 29, 2016

Related U.S. Application Data

(60) Provisional application No. 62/184,936, filed on Jun. 26, 2015.

(51) Int. Cl.

| | |
|---|---|
| ***H05B 33/00*** | (2006.01) |
| ***H05B 33/08*** | (2006.01) |
| ***B61L 13/00*** | (2006.01) |
| ***F21S 8/08*** | (2006.01) |
| ***F21S 9/02*** | (2006.01) |
| ***F21V 23/00*** | (2015.01) |
| ***H05B 37/02*** | (2006.01) |
| ***B61L 29/28*** | (2006.01) |
| ***B61L 29/30*** | (2006.01) |
| *F21Y 115/10* | (2016.01) |
| *F21W 131/103* | (2006.01) |
| *B61L 5/18* | (2006.01) |

(52) U.S. Cl.

CPC ..... *H05B 33/0854* (2013.01); *B61L 13/007* (2013.01); *B61L 29/288* (2013.01); *B61L 29/30* (2013.01); *F21S 8/08* (2013.01); *F21S 9/02* (2013.01); *F21V 23/001* (2013.01); *F21V 23/003* (2013.01); *H05B 33/0842* (2013.01); *H05B 37/0236* (2013.01); *B61L 5/1881* (2013.01); *B61L 2207/02* (2013.01); *F21W 2131/103* (2013.01); *F21Y 2115/10* (2016.08)

(58) Field of Classification Search

CPC .. B61L 13/007; F21S 8/08; F21S 9/02; H05B 33/0854; H05B 37/0236

See application file for complete search history.

(56) References Cited

U.S. PATENT DOCUMENTS 3,706,098 A * 12/1972 Geiger ..... B61L 29/286 246/125
4,813,066 A * 3/1989 Holtz ..... H04M 19/08 370/284
5,954,299 A * 9/1999 Pace ..... B61L 9/04 246/125

(Continued)

*Primary Examiner* — Monica C King
(74) *Attorney, Agent, or Firm* — Thompson Coburn LLP

(57) ABSTRACT

A system includes at least one signal light having at least one lamp. The system further includes a control device electrically connected to the at least one lamp by a conductive cable. The at least one lamp is configured to flash in response to the loss of an audio signal generated by the control device.

10 Claims, 3 Drawing Sheets

(56) References Cited

U.S. PATENT DOCUMENTS

| | | | | |
|---|---|---|---|---|
| 2009/0244880 | A1* | 10/2009 | Rapeanu | F21S 8/028<br>362/20 |
| 2011/0147535 | A1* | 6/2011 | Aisa | B61L 1/187<br>246/122 R |

* cited by examiner

SYSTEM AND METHOD FOR CONTROLLING A WAYSIDE DEVICE

CROSS-REFERENCE TO RELATED APPLICATIONS

The present application is a non-provisional application claiming the benefit of U.S. Provisional Application No. 62/184,936, filed Jun. 26, 2015, which is incorporated herein by reference in its entirety.

FIELD OF THE INVENTION

Embodiments of the invention relate generally to signaling systems and devices. Other embodiments relate to a system and method for controlling a wayside signaling device.

BACKGROUND OF THE INVENTION

Locations where a railroad track crosses a road, highway or other vehicular avenue are referred to as grade crossings. Grade crossings are typically outfitted with right of way equipment to notify motorists of the grade crossing and/or when a train is approaching the crossing. Typical right of way equipment may include crossing gates and wayside crossing signal lights.

Many years ago, incandescent bulbs powered by DC voltage were the standard for such wayside crossing signal lights. After this, AC lighting of such crossing signal lights became standard, before a change back to DC lighting occurred. This change back to DC lighting was spurred by the use of electronic controllers. In the early 2000s, the lamp itself was improved by the introduction of the light emitting diode ("LED"). These LEDs typically run on 12VDC and include an integrated regulation feature that holds the lamp voltages steady with various input voltages applied.

Installation of known LED signal lights and associated control equipment has proven costly. In particular, such systems require many runs of cabling between each signal light and a wayside control house that contains the control electronics for controlling operation of the signal lights. This cabling is expensive in and of itself, and is costly and laborious to bury beneath the ground adjacent to the roadway. In addition, existing control systems are relatively complex and the control of signal lamps is concentrated to one device making the signaling system susceptible to common mode failure.

What is needed, therefore, is a signaling system and method that differ from existing systems.

BRIEF DESCRIPTION OF THE INVENTION

In an embodiment, a system includes at least one signal light including at least one lamp. The system further includes a control device electrically connected to the at least one lamp by a conductive cable. The at least one lamp is configured to flash in response to the loss of an audio signal generated by the control device.

In another embodiment, a system includes at least one signal light pair and a control device. The signal light pair includes at least a first lamp and a second lamp. The control device is electrically connected to the first lamp and second lamp of the signal light pair by a conductive cable. The first lamp and the second lamp are configured to flash in response to the absence of an audio signal generated by the control device.

In another embodiment, a method (e.g., a method of controlling a wayside device) includes transmitting, with a control device, an audio signal over a conductive cable that is electrically connected to at least one lamp of a signal light. The method further includes the at least one lamp automatically flashing in response to a loss of the audio signal.

BRIEF DESCRIPTION OF THE DRAWINGS

The present invention will be better understood from reading the following description of non-limiting embodiments, with reference to the attached drawings, wherein below.

DETAILED DESCRIPTION OF THE INVENTION

Figure 1:
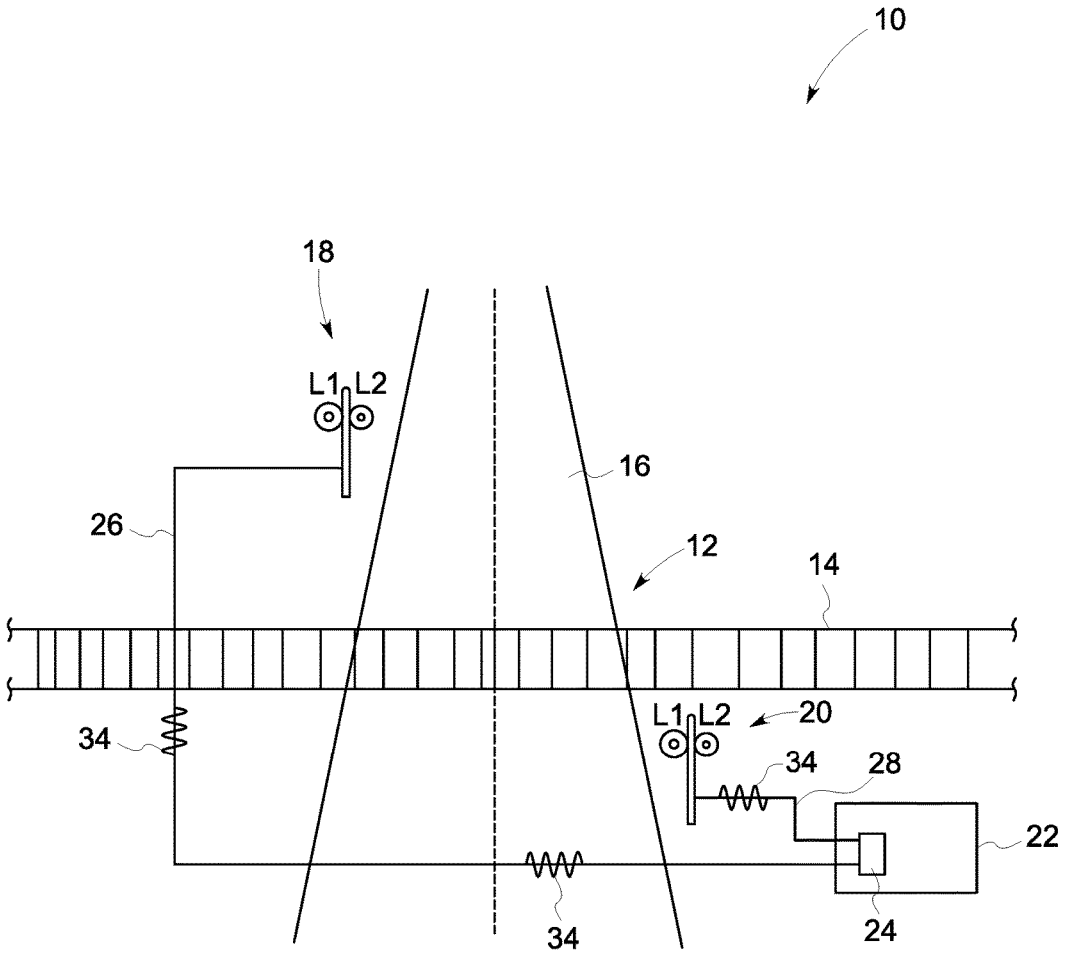
FIG. 1 is a simplified schematic drawing of a wayside signaling system, according to an embodiment of the invention.

Reference will be made below in detail to exemplary embodiments of the invention, examples of which are illustrated in the accompanying drawings. Wherever possible, the same reference numerals used throughout the drawings refer to the same or like parts. Although exemplary embodiments of the invention are described with respect to wayside signaling systems and wayside crossing lights, embodiments of the invention may also be applicable to signaling systems and control systems for signal lights, generally. As used herein, "electrical contact," "electrical communication" and "electrically coupled" means that the referenced elements are directly or indirectly connected such that an electrical current may flow from one to the other. The connection may include a direct conductive connection (i.e., without an intervening capacitive, inductive or active element), an inductive connection, a capacitive connection, and/or any other suitable electrical connection. Intervening components may be present.

FIG. 1 illustrates an embodiment of a wayside signaling system 10, which is intended to be deployed at a grade crossing 12 where a first route 14 intersects a second route 16. For example, the grade crossing may be a highway-rail grade crossing where a railroad track intersects a highway or other vehicle pathway. The system includes at least one signal light. For example, the system may include a plurality of crossing signal lights, such as a first crossing signal light pair 18 and a second crossing signal light pair 20. While FIG. 1 illustrates a pair of crossing signal light pairs, more than two crossing signal light pairs may be present at any given grade crossing. The system 10 also includes a control house or other enclosure 22 located locally adjacent to the track 14, which houses a control device 24. The control device 24 is electrically connected to each of the crossing signal light pairs 18, 20 by conductive cables 26, 28 buried beneath the ground. In an embodiment, the conductive cables 26, 28 are wires, such as battery wires configured to provide power to the crossing signal light pairs 18, 20.

Figure 2:
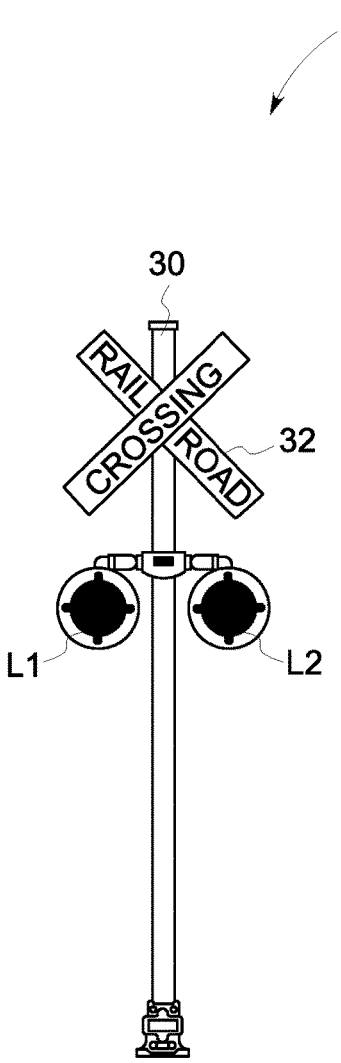
FIG. 2 is a schematic illustration of a post-mounted wayside crossing light of the system of FIG. 1.
Figure 3:
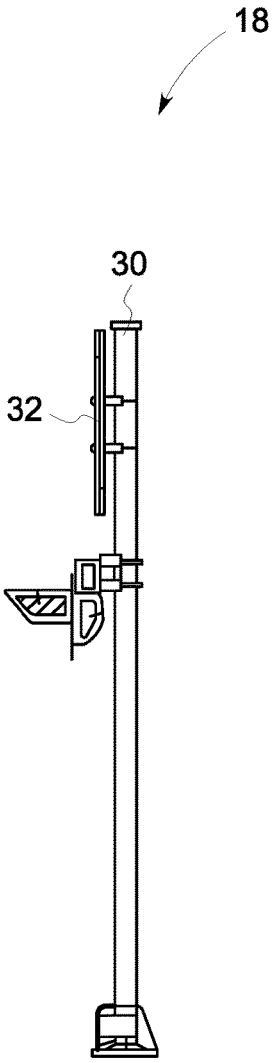
FIG. 3 is a schematic side view of the wayside crossing light of FIG. 2.

As best illustrated in FIGS. 2 and 3, each crossing signal light pair, such as the first crossing signal light 18, includes a mast 30 on which a crossing sign 32 and a pair of signal lamps are mounted. As shown, the signal lamps include a first signal lamp L1 and a second signal lamp L2. In an embodiment, with further reference to FIG. 4, the lamps L1 and L2 include respective arrays 36, 38 of light emitting diodes (in FIG. 4, "n" represents a whole real number of at least two, that is, each array includes at least "n" LEDs, where n is a real whole number greater than or equal to 2) and an electronic control circuit 40 that is configured to respond to a controlled audio signal 34 generated by the control device 24, as discussed hereinafter. Biasing components 42, such as resistors, may be operatively coupled to the control circuit 40 and/or the LED's 36, 38 for driving and/or biasing the LEDs. In an embodiment, the LEDs conform to the size focus and intensity requirements of the rail industry as defined in The American Railway Engineering and Maintenance-of-Way Association (AREMA) standards. Likewise, the control device 24 is configured to meet AREMA standards.

As indicated above, in embodiments, the flash control electronics for the lamps L1, L2 are integrated into the lamps themselves. In particular, flashing of the L1 or L2 LEDs is controlled, at a basic level, by the on-board control electronics 40 of each array. In addition, each array may be selectively designated as lamp 1 (L1) type or lamp 2 (L2) type via a hardware setting on the lamps or LEDs. Accordingly, each array of LEDs, L1 type or L2 type, is configured to respond to the appropriate loss of audio signal 34 generated by the control device 24 and flash appropriately in response to the audio signal such as, for example, lamp L1 flashes then lamp L2 flashes. While, every LED is intended to be identical, they will respond as either L1 flasher or L2 flasher after being configured to do so by varying the hardware setting.

In an embodiment, the control device 24 is configured to hold off the lamp L1 and L2 LEDs from flashing by transmitting an audio signal 34 to the lamps, and to remove the audio signal(s) in order to flash the LEDs. In particular, the control device 24, in effect, holds the lamps L1, L2 off when they are not required to flash. In connection with the above, the electronic circuit 40 integrated with each lamp L1 or L2 (or integrated with each lamp pair) is configured to respond to the controlled audio signal 34 from the control device 24 that serves to synchronize and alternate the flashes of each lamp at a determined rate. Accordingly, if the control device 24 suffers a malfunction or ceases operation, no audio signal will be transmitted, and the lamps L1 and L2 will be in a restrictive state of ON and flashing. This is referred to as 'fail-safe' mode. In an embodiment, the control device 24 is configured to coordinate the audio signals to sync all L1 and L2 flashes for the various crossing signal lights at a given grade crossing. If the control device 24 fails, the lamps will flash without synchronization.

The system 10 therefore provides for graceful degradation in the event of failure within the system. In particular, because the flash control electronics are on-board each lamp or lamp pair, if one LED fails, the others will continue to flash as intended. In addition, if the control device 24 fails, all LEDs will flash, although not in sync. Accordingly, a single point of failure is not compounded throughout the entire system, as is the case with conventional systems. In particular, because existing systems flash the LEDs from the control unit, if the control unit fails, all lamp L1 or lamp L2 LEDs at the grade crossing will cease to operate properly. Accordingly, the system 10 provides individual failing points, which is in contrast to existing systems that are at risk to common mode failures.

In addition, the system 10 allows multiple distributed LEDs to be controlled from the single control device 24, allowing for cost savings to be realized. Moreover, by controlling the lamp L1 and lamp L2 LEDs utilizing audio signals 34 generated by the single control device 24 and transmitted over existing battery wires 26, 28, the amount of cabling between the control house 22 and signal masts and complexity of the control device 24 may be reduced.

Figure 4:
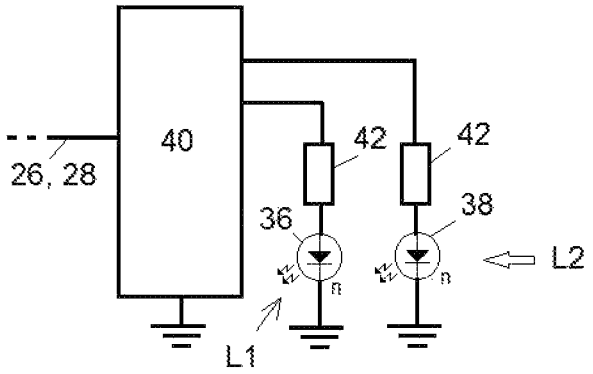
FIG. 4 is an electrical schematic diagram of an embodiment of a lamp pair portion of the wayside signal system.

FIG. 4 shows one flash control circuit associated with two lamps L1, L2. For example, the control circuit may be integral with a lamp pair. However, in other embodiments, each lamp L1, L2 has its own respective flash control circuit integrated into the lamp. (Such that a lamp pair will have two flash control circuits.)

The audio signal 34 includes at least one signal having a frequency within a range of from 60 Hz to 20 kHz. Signals within frequencies of this range can be imposed, for example, over existing conductive cables, such as battery wires, that carry 12 VDC or other electrical power. (That is, the conductive cables 26 may carry electrical power, and the audio signal is transmitted over the same cable that carries the electrical power, concurrently therewith.) In embodiments, the audio signal includes two signals within this frequency range. In embodiments, the audio signal includes at least one signal having a frequency within a range of 1 kHz to 10 kHz. (Frequencies within this latter range may face a lower resistance or impedance when applied to an existing cable run, versus signals at frequencies outside this range.) In embodiments, the audio signal includes two signals within this frequency range. (In the case of two signals, one signal may be respectively associated with each lamp, or they may be associated with both lamps, with the control circuit configured to respond to the loss of either to initiate lamp flashing.)

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions and types of materials described herein are intended to define the parameters of the invention, they are by no means limiting and are exemplary embodiments. Many other embodiments will be apparent to those of skill in the art upon reviewing the above description. The terms "including" and "in which" are used as the plain-English equivalents of the respective terms "comprising" and "wherein." Moreover, the terms "first," "second," "third," "upper," "lower," "bottom," "top," etc. are used merely as labels, and are not intended to impose numerical or positional requirements on their objects.

This written description uses examples to disclose several embodiments of the invention, including the best mode, and also to enable one of ordinary skill in the art to practice the embodiments of invention, including making and using any devices or systems and performing any incorporated methods.

As used herein, an element or step recited in the singular and proceeded with the word "a" or "an" should be understood as not excluding plural of the elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

Since certain changes may be made in the embodiments described herein, it is intended that all of the subject matter of the above description or shown in the accompanying drawings shall be interpreted merely as examples illustrating the inventive concept herein and shall not be construed as limiting the invention.

The invention claimed is:

1. A system comprising:

a signal light including at least one lamp;

a conductive cable concurrently carrying a power signal and an audio signal to an electronic control circuit of the lamp; and a control device electrically connected to the electronic control circuit by the conductive cable, the control device arranged to hold off the at least one lamp from flashing by transmitting the audio signal to the at least one lamp;

wherein the at least one lamp is configured to flash in response to the loss of the audio signal generated by the control device.

2. The system of claim 1, further comprising:

a biasing component; and at least one light emitting diode, the biasing component operatively coupled to each the electronic control circuit of the signal light and the at least one light emitting diode to drive and/or bias the at least one light emitting diode.

3. The system of claim 2, wherein failure of either the biasing component or the at least one light emitting diode does not cause failure of the control device or operation of the system.

4. The system of claim 1, wherein the system is an individual failing point system.

5. The system of claim 1, wherein failure of the control device ceases transmission of the audio signal allowing the system to enter a fail-safe mode, the fail-safe mode activating the at least one lamp to flash in response to the loss of the audio signal.

6. The system of claim 1, wherein the signal light is a signal light pair, and the at least one lamp comprises at least a first lamp and a second lamp, the control device being electrically connected to the first lamp and the second lamp by the electronic control circuit connected to the conductive cable, and the first lamp and the second lamp being configured to flash in response to the loss of the audio signal generated by the control device.

7. The system of claim 6, wherein the audio signal includes a first audio signal and a second audio signal.

8. The system of claim 7, wherein the first and second audio signals have a frequency range from 60 Hz to 20 kHz.

9. The system of claim 7, wherein the first audio signal is associated with operation of the first lamp and the second audio signal is associated with operation of the second lamp.

10. The system of claim 7, wherein the first and second audio signals are associated with both the first and second lamps, the electronic control circuit configured to respond to the loss of either the first or second audio signal and initiate flashing of the first and second lamps.

* * * * *